United States Patent [19]

Faessler et al.

[11] Patent Number: 4,623,014

[45] **Date of Patent: * Nov. 18, 1986**

[54] PROCESS FOR THE PRODUCTION OF PRECISION CASTINGS

[75] Inventors: Fritz Faessler, Limburgerhof; Siegmund Stadler, Dudenhofen, both of Fed. Rep. of Germany

[73] Assignee: Giulini Chemie GmbH, Ludwigshafen am Rhein, Fed. Rep. of Germany

[ * ] Notice: The portion of the term of this patent subsequent to Sep. 17, 2002 has been disclaimed.

[21] Appl. No.: 617,004

[22] Filed: Jun. 4, 1984

[30] Foreign Application Priority Data

Jun. 4, 1983 [DE] Fed. Rep. of Germany ..... 3320309

[51] Int. Cl.[4] ..... B22D 9/00

[52] U.S. Cl. ..... 164/7.1; 164/14; 164/44; 164/61; 164/519

[58] Field of Search ..... 164/6, 14, 15, 34, 35, 164/36, 44, 61, 253, 254, 255, 361, 516, 517, 518, 519, 7.1

[56] References Cited

U.S. PATENT DOCUMENTS

| | | | |
|---|---|---|---|
| 3,825,058 | 7/1974 | Miura et al. | 164/253 |
| 3,923,525 | 12/1975 | Toeniskoetter et al. | 106/38.3 |

FOREIGN PATENT DOCUMENTS

| | | | |
|---|---|---|---|
| 1939433 | 8/1969 | Fed. Rep. of Germany . | |
| 1940924 | 8/1969 | Fed. Rep. of Germany . | |
| 2318850 | 4/1973 | Fed. Rep. of Germany . | |
| 2418348 | 4/1974 | Fed. Rep. of Germany . | |
| 54-46128 | 4/1979 | Japan | 164/187 |
| 57-81939 | 5/1982 | Japan | 164/519 |
| 533444 | 12/1976 | U.S.S.R. | 164/34 |

*Primary Examiner*—Nicholas P. Godici
*Assistant Examiner*—Richard K. Seidel
*Attorney, Agent, or Firm*—Sughrue, Mion, Zinn, Macpeak, and Seas

[57] ABSTRACT

Process for the production of precision castings with well-defined reproduction of detail and a great accuracy of measurement, by which the pattern to be reproduced is equipped with a drainage apparatus, having at least one duct extending outside the molding box, and the molding material containing phosphate as the bonding agent is poured in the molding box and solidified. After the pattern is removed from the solidified mold, by the introduction of compressed gas, the water of the solidified material is pressed out, and after calcining at a temperature of at least 250° C., the mold is connected to a vacuum line and evacuated. The molten metal mass is then poured into the mold while the vacuum is maintained and solidified.

14 Claims, 1 Drawing Figure

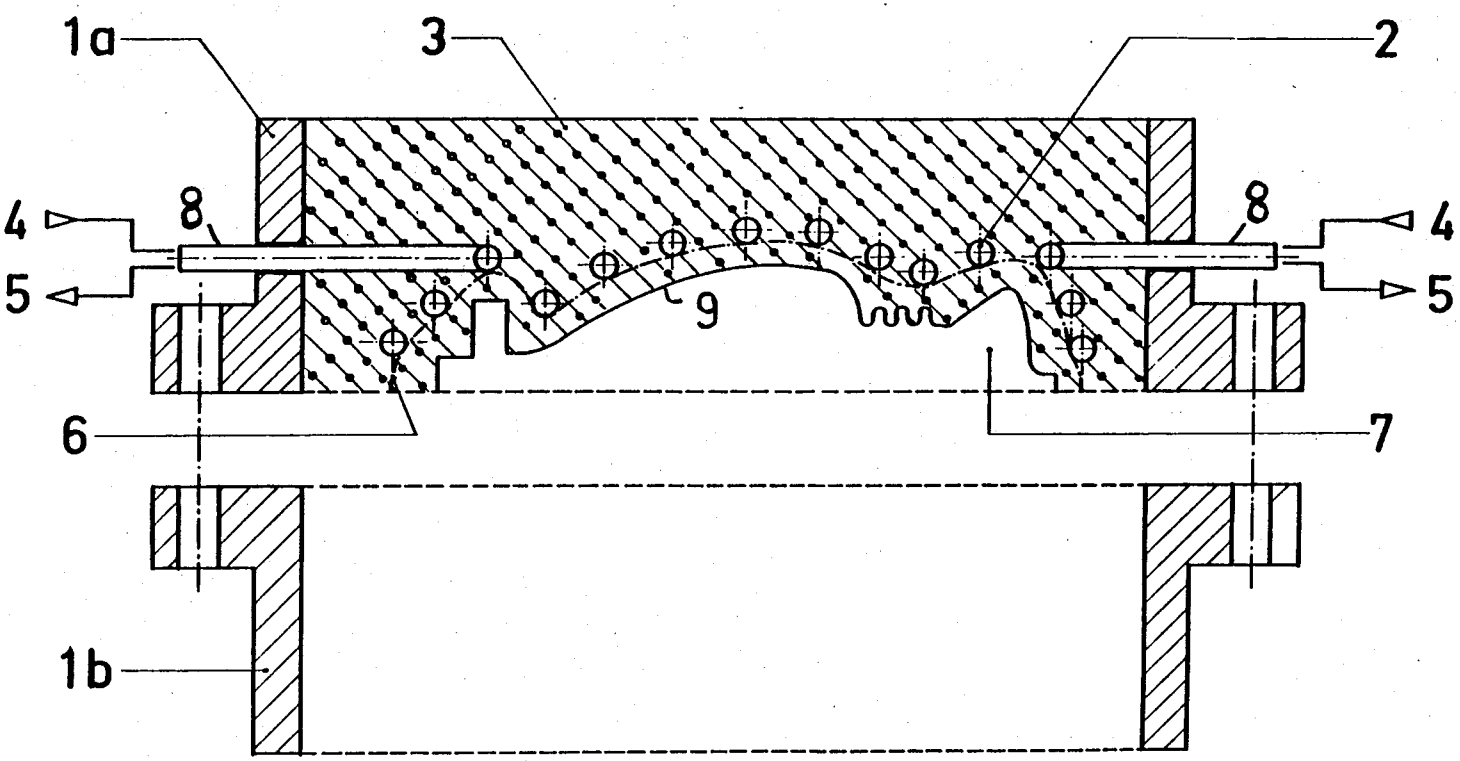
2
4
5
8
7
9
3
1a
8
4
5
6
1b

PROCESS FOR THE PRODUCTION OF PRECISION CASTINGS

BACKGROUND OF THE INVENTION

The present invention relates to a new process for the production of castings with well-defined reproduction of detail and a high accuracy of dimensional tolerance using a new molding process. The new molding process is especially suitable for high-melting metals and alloys.

Molding processes for high-melting metals are known, as well as for precision casting. The best known precision casting molding process is the lost wax process, by which the pattern is melted out for the preparation of the mold. Other processes use synthetic materials or frozen mercury as the material for the pattern. A disadvantage of this molding process is that in order to obtain a precision casting, a number of auxilliary agents and additional measures are required, so that still today in many branches of industry precision casting is considered unsatisfactory as a means for industrial mass production, in particular as too cost intensive and requiring too much labor. Patterns for high melting ferrous and non-ferrous metals must be covered with a fine coating of high-grade, largely silicon bonded ceramic synthetic, because only in that way is a smooth surface produced so that the finest contours can be reproduced. Only then can the molding material, which provides the mold with the stability necessary to withstand the casting pressure, be poured into the molding box.

U.S. Pat. No. 3,825,058 discloses a process for preparing a mold by a vacuum sealed molding process in which a particulate material, for example, sand, is placed inside a molding box, subjected to a vacuum and compressed to form a mold. The mold has a casting cavity which is defined by a shield member, impermeable to gas, made of synthetic material (plastic) or metal foil. In order to prevent breakdown of the mold during pouring of a molten metal, a tubular member forming a passage serving as a communication means between the mold cavity and the atmosphere is connected to the uppermost portion of the shield member so that the atmospheric pressure can be imparted to the cavity. In this way, the vacuum in the space between the particles is certain.

U.S. Pat. No. 3,923,525 discloses foundry molding materials (foundry mixes) which contain an aggregate, for example, sand, and up to about 10 weight % in relation to the foundry molding material of a binder system, with the binder system consisting of 60 to 95 weight % aluminum phosphate containing boron, 5 to 40 weight % alkaline earth oxide or alkaline earth hydroxide, and 15 to 50 weight % water. The foundry mold materials according to the patent are processed to foundry shapes or casting molds in the following steps:

(1) introducing the foundry mix into a mold or pattern to thereby obtain a green foundry shape;

(2) allowing the green foundry shape to remain in the mold or pattern for a time at least sufficient for the shape to obtain a minimum stripping strength (i.e., become selfsupporting); and (3) thereafter removing the shape from the mold or pattern and allowing it to cure at room temperature, thereby obtaining a hard, solid, cured foundry shape.

The patent states that the binder systems cure at room temperature. The patent does not contain any disclosure of calcining (burning) the binder at a temperature of at least 250° C. after removal of water.

The patent states that it it recognized that the use of the binder system for the foundry shapes intended in the patent is quite distinct from preparing other shaped articles such as ceramics and shapes for precision casting. In particular, the patent states that a suitable binder for shapes for precision casting will not necessarily be applicable as the binder in foundry shapes of the patent.

SUMMARY OF THE INVENTION

It is an object of the present invention to provide a process for the reproduction of precision castings that is especially suitable for high melting metals and alloys and does not have the disadvantages mentioned above.

Additional objects and advantages of the present invention will be set forth in part in the description or can be learned by practice of the invention. The objects and advantages are achieved by means of the processes, instrumentalities and combinations particularly pointed out in the appended claims.

To achieve the foregoing objects and in accordance with its purpose, the present invention provides a process for production of a precision casting, by which a porous foundry mold is used, produced from a pattern in a molding box out of a castable molding material, containing phosphate as the bonding agent, comprising: (a) coating the pattern to be copied with a mold release agent and providing the molding box with a drainage having at least one duct which extends outside the molding box; (b) pouring the molding material containing phosphate (in statu nascendi) as the bonding agent into the molding box and a portion of the drainage within the molding box, and solidifying the molding material in the molding box to form a solidified mold; (c) removing the water from the solidified mold by introducing compressed gas into the drainage, whereby the pattern separates from the solidified mold, and removing the separated pattern from the solidified mold, then calcining the mold at a temperature of at least 250° C.; (d) connecting the calcined mold to a vacuum line and evacuating the calcined mold; and (e) pouring a molten metal mass into the mold while the vacuum is maintained and solidifying the molten metal.

A significant characteristic of the process of the present invention is that the water adhering to the molding material is removed through pressurized gas dehydration. In this way, substantial amounts of energy can be saved, so that the casting process is now applicable also to large surface precision casting and series casting. The energy requirement is further lowered through evacuation during metal casting, with the additional advantage that pressurized gas dehydration and evacuation can be carried out through the same system of drainage apparatus.

In one embodiment of the present invention, a porous hose is used as the drainage, and the porous hose preferably is applied over a close-meshed and moldable wire netting. In another embodiment of the present invention, a perforated fiberglass mat is used as the drainage. Preferably, the drainage for the pattern is mounted with a separation of at least 10 mm from the pattern, especially when a porous hose is employed.

Preferably, the water is removed from the solidified mold material with compressed air, and more preferably the water is forced out by an increasing pressure. It is also preferred to raise the pressure by approximately 0.01 bar per minute until it reaches approximately 1.2 bar.

The calcination of the mold preferably is carried out at 260° to 300° C. The molten metal preferably is poured into the mold under a vacuum of 0.6 bar and is solidified while maintaining the vacuum. Preferably, the molding material comprises or consists essentially of active magnesium oxide, monoammonium phosphate, quartz sand and/or zircon sand, water, and known auxilliary agents.

It is to be understood that both the foregoing general description and the following detailed description are exemplary, but are not restrictive of the invention.

BRIEF DESCRIPTION OF THE DRAWING

The sole FIGURE of the drawing shows a cross-section through a molding box for producing a casting mold in accordance with one embodiment for practicing the process of the present invention.

DETAILED DESCRIPTION OF THE INVENTION

In the practice of the present invention, for the production of the molding material, which contains as the high temperature bonding agent a phosphate bonding agent produced from active magnesium oxide or active magnesium hydroxide and monoammonium orthophsphate, quartz sand and/or zircon sand is used. Inhibitors and other auxilliary agents, for example, temperature resistant filler materials, can be added to the mixture if necessary. In the presence of water, the active magnesium oxide reacts with the ammonium orthophosphate under heat buildup, so that depending on the reactivity of the magnesium oxide, the concentration of the ammonium-magnesium orthophosphate, and the volume of the water, solidification begins. Moreover, the volume of water must be cut off at the desired pore volume of the mold, so that a sufficient gas permeability is obtained when putting into operation the drainage apparatus according to the invention. (Thus, the volume of water should be selected to achieve a desired pore volume of the resulting mold, that is, the solidified molding material from which water has been removed by pressing out.) The pore volume should total about 15%. With a defined grain distribution of the quartz and/or zircon sand (a few microns, for example, 2 microns, to 3 mm), a smooth surface of the mold is obtained.

Since the magnesium orthophosphate which is formed contains 6 molecules of water of crystallization, calcination is required after the solidification process has ended. The calcination temperature should be at least 250° C., so that along with the water of crystallization a part of the bonded ammonia will also be released. In this way, degassing during the casting process is made easier and the surface quality of the casting is improved.

High-melting metals and metal alloys are here understood to be those with melting points above 1000° C., and particularly above 1100° C.

The original that is to be reproduced, that is, the pattern, is covered with a mold release agent, for example, a thin oil film, and the molding body is furnished with a drainage which can be in the form of a porous hose or a perforated fiberglass mat before the mold casting. If the hose method is used, it is desirable to first apply a close-meshed wire netting that is positioned over the original at a distance of about 10 mm and is easily pliable. Finally, the hose is affixed over the wire mesh in a coiled manner, and one end is led outside through the mold box or the chill, respectively, by connecting the hose to a duct which extends into the molding box and forms part of the drainage. If perforated fiberglass mats are used, no meshed wire netting is necessary. The fiberglass mats and the nettings can be attached to the molding box. They do not contact the pattern. In practicing the invention, the drainage preferably is distributed over the original in a regular or uniform manner so that all areas of the original can be evenly treated by the drainage.

After mixing, the mold material is poured into the prepared molding box to cover the pattern and the drainage on the pattern. Depending on the molding, an upper or lower frame or sectional mold can be used. The molding material is then solidified in the molding box to the shape of the original to provide a negative mold.

Immediately after solidifying of the molding material, the solidified molding material is connected to a compressed air conductor for the removal of water by attaching the compressed air conductor to the drainage in the solidified material via the duct, whereby the original is removed from the mold and from the molding box. The removal of the water is preferably carried out with an increase in pressure of 0.01 bar per minute, and indeed, the pressure is continuously increased, for example, from a starting pressure of about 0.2 bar, until approximately 1.2 bar is reached. For complete water removal, this final pressure is maintained for some time, about 10 to 20 minutes.

In most cases, 10 to 20 minutes at the final pressure is sufficient to completely remove the water. The pore volume is formed by removing the water with the compressed gas and is of particular importance for subsequent metal casting.

After the water is removed, the negative mold can be immediately, or after storage, calcined in the air at a temperature of at least 250° C. The calcination is necessary, so that a sufficient vacuum efficiency can be produced during the subsequent metal casting.

After the calcination, and before the metal is cast, a vacuum line is connected to the solidified mold via the drainage. This can be carried out either with a direct working vacuum pump of sufficient capacity, or also with a preevacuated container. Directly before the metal casting, the negative molding is evacuated and the molten mass is poured directly in. The evacuation is continued until the molten metal mass solidified.

The maximum gas amount during the evacuation is 4001/sq. m molding surface. For reduction of vacuum loss, it is essential for the process according to the invention that the thickness of the back wall of the mold is greater than the distance between the hose and the work surface. In most cases, a double or triple wall thickness suffices.

With careful processing, and above all, regular distribution of the drainage, very smooth metal surfaces are formed, which are technically advantageous.

Referring now the drawing, there is shown a cross-section (side view) through a molding box for producing a casting mold in accordance with one embodiment of the process according to the present invention. As shown in the drawing, a molding box is comprised of a first section 1*a* in the form of an upper box-half and a second section 1*b* in the form of a lower box-half.

A pattern 7 lies in box-half 1*a* and is surrounded with a wire net 6, on which a porous hose 2 is arranged in a coiled manner. Ducts or channels 8 extend into section 1a and are connected to porous hose 2. Pressurized gas is introduced through ducts 8, as represented by air gas line 4, and the vacuum is applied through the same ducts 8, as represented by vacuum line 5. The molding material is designated with the reference number 3. Pattern 7 has a work surface 9. The backwall is the external surface of the molding box 3 and the thickness of the backwall the distance from the center of the hose 2 (drainage) to the external surface of the molding box. Similarly the distance between the work surface and hose is measured from the center of the hose.

The present invention is to be contrasted with the vacuum-sealed molding process of U.S. Pat. No. 3,825,058, and provides a new process in which there is a casting of a molten mass while vacuum is maintained on the contacting surfaces of mold to metal in the evacuated mold. In the present invention, neither a protective layer of synthetic material or a metal layer, nor a vacuum is required to form a casting mold. Moreover, the casting mold does not decompose into particulate material by termination of the vacuum, with the so decomposed particulate material then being used for the production of another mold by means of a vacuum. The casting mold of the present invention is not produced by a vacuum-sealed molding process. Moreover, in the present invention, the casting mold is held under a vacuum during the casting of the metal and the solidifying. Further, an air passage to contact the mold with the atmosphere is unnecessary. In the present invention, the vacuum is required during the casting of the metal in the mold, not for the maintenance of the mold between the particles of the fine-particled matter. Moreover, in the present invention the porous gas conducting elements are positioned for the introduction of compressed gases in order to remcve water.

The following examples are given by way of illustration to further explain the principles of the invention. These examples are merely illustrative and are not to be understood as limiting the scope and underlying principles of the invention in any way. All percentages referred to herein are by weight unless otherwise indicated.

EXAMPLE 1

For the production of a negative mold, a synthetic material fitting (pattern), approximately 20×10×8 cm, was coated with an extremely thin oil film as the mold release agent, and placed in a molding box with inside measurements of 24×14×11 cm. On the surface of this original, a malleable wire netting of approximately 2 to 3 cm mesh was fitted. After this fitting, a porous woven hose of 8 mm diameter was wound on with a lateral separation of about 2 cm, and the hose was attached to a duct or socket mounted on the molding box. This drainage apparatus was fixed approximately 1 cm above the pattern.

The thus prepared molding box was filled with a molding material prepared from 6 kg of a powder mixture comprising:

8.0% active MgO
8.0% monoammonium phosphate
84.0% quartz sand (grain size less than 1 mm)

which was mixed homogeneously for one minute with 1.2 liters of water. The molding material was poured into the molding box in a thin stream, beginning in the middle to avoid formation of adhering bubbles.

One minute after the solidification is complete (determined by pressing with a finger) compressed air was connected to the drainage via the duct. The beginning pressure was 0.2 bar, and the pressure was increased by 0.01 bar per minute. After 100 minutes, the pressure was 1.2 bar, which was maintained until no more water was evacuated.

By application of pressure, the original was separated from the molding material. The molding box with the negative pattern was smoothly lifted up and set on end, so that the water which had been removed could run off freely.

The calcination of the molding box with the negative mold took place at 250° C.

After calcination, the molding box with the negative pattern was connected via the drainage to a vacuum hose for subsequent iron casting (M.P. 1250° C.). A negative pressure of −0.9 bar was applied. The molten iron was poured into the evacuated mold. Demolding of the casting followed after complete solidification of the iron, which was the case after 20 minutes.

EXAMPLE 2

Instead of the porous hose applied in Example 1, a perforated mineral wool fiber mat 2 cm thick was used. The diameter of the perforations was 1.5 cm, and the distance from perforation to perforation was 2 to 3 cm. In order to prevent the mineral wool mat from floating up, it was briefly dipped in water. Before fixing the drainage in place, the molding box was filled with the molding material about 1 cm over the original, and then the mineral wool fiber mat was affixed at a distance of approximately 1 cm over the surface of the original, after which the molding box was filled up. Release, evacuation and metal casting followed as in Example 1.

It will be understood that the above description of the present invention is susceptible to various modifications, changes and adaptations, and the same are intended to be comprehended within the meaning and range of equivalents of the appended claims.

What is claimed is:

1. A process for production of a precision casting by which a porous foundry mold is produced from a pattern in a molding box out of a castable molding material, containing phosphate as the bonding agent, comprising:

(a) coating the pattern to be copied with a mold release agent and providing the molding box with a drainage having at least one duct which extends outside the molding box;

(b) pouring the molding material containing phosphate (in statu nascendi) as the bonding agent into the molding box and around a portion of the drainage which is within the molding box, and solidifying the molding material in the molding box to form a solidified mold having a mold cavity;

(c) removing the water from the solidified mold by introducing compressed gas into the drainage, whereby the pattern separates from the solidified mold, removing the pattern from the solidified mold, and then calcining the mold at a temperature of at least 250° C.;

(d) connecting the calcined mold to a vacuum line and evacuating the calcined mold; and (e) pouring a molten metal mass into the mold while the vacuum is maintained and solidifying the molten metal.

2. The process according to claim 1, wherein a porous hose is used as the drainage.

3. The process according to claim 2, wherein the porous hose is applied over a close-meshed and moldable wire netting.

4. The process according to claim 1, wherein a perforated fiberglass mat is used as the drainage.

5. The process according to claim 1, wherein the drainage for the molding box is mounted with a separation of at least 10 mm from the pattern.

6. The process according to claim 1, wherein the water is pressed out of the solidified mold material with compressed air.

7. The process according to claim 6, wherein the water is forced out by increasing pressure.

8. The process according to claim 7, wherein the pressure is raised by approximately 0.01 bar per minute until it reaches approximately 1.2 bar.

9. The process according to claim 1, wherein the calcination of the mold is carried out at 260° to 300° C.

10. The process according to claim 1, wherein the molten metal is poured into the mold under a vacuum of 0.6 bar and is solidified while maintaining the vacuum.

11. The process according to claim 1, wherein the molding material comprises active magnesium oxide, monoammonium phosphate, at least one material selected from quartz sand and zircon sand, and water.

12. The process according to claim 1, wherein the vacuum is maintained during solidifying of the molten metal.

13. The process according to claim 12, wherein the mold is connected with the vacuum line via the drainage.

14. The process according to claim 1, wherein the mold is connected with the vacuum line via the drainage.

* * * * *